US009867242B1

(12) United States Patent
Gao et al.

(10) Patent No.: US 9,867,242 B1
(45) Date of Patent: Jan. 9, 2018

(54) SYSTEM AND METHOD OF OPERATING A CONSTANT CURRENT LIGHT-EMITTING DIODE PULSING DRIVE CIRCUIT

(71) Applicant: Datalogic ADC, Inc., Eugene, OR (US)

(72) Inventors: WenLiang Gao, Eugene, OR (US); Pat O'Donnell, Eugene, OR (US)

(73) Assignee: Datalogic USA, Inc., Eugene, OR (US)

( * ) Notice: Subject to any disclaimer, the term of this patent is extended or adjusted under 35 U.S.C. 154(b) by 0 days.

(21) Appl. No.: 15/376,218

(22) Filed: Dec. 12, 2016

(51) Int. Cl.
*H05B 33/08* (2006.01)
*H05B 37/02* (2006.01)

(52) U.S. Cl.
CPC ..... *H05B 33/0827* (2013.01); *H05B 33/0842* (2013.01); *H05B 33/0887* (2013.01); *H05B 37/0281* (2013.01)

(58) Field of Classification Search
CPC ..... H05B 33/0815; H05B 33/0851; H05B 33/0872; H05B 37/02; Y02B 20/347; Y02B 20/48
USPC ..... 315/291, 294, 297, 307, 312, 360, 362, 315/224, 247, 185 S, 169.3; 340/636.12, 340/815.45
See application file for complete search history.

(56) References Cited

U.S. PATENT DOCUMENTS 5,319,303 A * 6/1994 Yamada ..... G05F 1/56 323/274
7,038,594 B2 * 5/2006 Voreis ..... H05B 33/0815 315/224
7,656,371 B2 * 2/2010 Shimizu ..... H05B 33/0872 315/169.3
7,825,610 B2 * 11/2010 Zhao ..... H05B 33/0815 315/185 S

* cited by examiner

*Primary Examiner* — Haissa Philogene
(74) *Attorney, Agent, or Firm* — Shook, Hardy & Bacon L.L.P.

(57) ABSTRACT

Tuning a bias voltage supplied to a series of one or more LEDs in a constant current LED pulsing drive circuit may comprise the steps of: (A) setting the bias voltage to a test value, the test value being at least equal to the sum of the bias voltage second component and the maximum forward voltage rating of each of the one or more LEDs; (B) measuring an intermediate voltage present between the series of one or more LEDs and the constant current source when the LEDs are turned on; (C) determining if the intermediate voltage exceeds the second component of the bias voltage; and (D) upon determining the intermediate voltage exceeds the second component of the bias voltage, reducing the bias voltage applied to the one or more LEDs by an amount necessary to cause the intermediate voltage to equal the second component of the bias voltage.

16 Claims, 9 Drawing Sheets

SYSTEM AND METHOD OF OPERATING A CONSTANT CURRENT LIGHT-EMITTING DIODE PULSING DRIVE CIRCUIT

CROSS-REFERENCE TO RELATED APPLICATIONS

Not applicable.

TECHNICAL FIELD

This disclosure describes systems of, and methods to efficiently operate, constant current light-emitting diode ("LED") pulsing drive circuits where the pulses of current have very short duration.

BACKGROUND OF THE INVENTION

A "forward voltage" as used herein refers to the voltage drop across a component, or a plurality of components, of a constant current LED pulsing drive circuit. For example, the forward voltage across an LED is the voltage drop across the LED. Similarly, the forward voltage across a series of LEDs is the voltage drop across the series of LEDs.

A "bias voltage" as used herein refers to a voltage having a value comprised of at least two components: a first component associated with the forward voltage across one or more LEDs, and a second component associated with the voltage across the other components in series with the one or more LEDs.

An LED will emit light when at least a minimum voltage (hereinafter "$V_{min}$") is supplied to appropriate leads of the LED. Most LEDs are produced in batches. The $V_{min}$ of each LED in a batch will be between a range of forward voltages. The $V_{min}$ of each LED may change over the life of the LED but will remain between the range of forward voltages. LEDs are manufactured, however, in batches having a wide range of forward voltages. For exemplary purposes only, an LED batch may have a range of forward voltages between 1.7 volts to 3.4 volts.

Referring to FIG. 1A (Prior Art), an exemplary constant current LED pulsing drive circuit is shown having a series of four LEDs 1 and a fixed voltage supply 2. Previously, if the series of four LEDs 1 were from the example batch above (i.e., range of forward voltages being 1.7 volts to 3.4 volts), then each of the series of four LEDs 1 would be assumed to have a forward voltage of 3.4 volts (i.e., the worst case scenario). Hence, the first component of the bias voltage supplied through the series of four LEDs 1 would be 13.6 volts. This is inefficient, however, because the $V_{min}$ of each of the series of four LEDs 1 may be less than 3.4 volts (in fact, the $V_{min}$ could be as small as half that amount). When a supplied voltage exceeds the $V_{min}$, the additional voltage supplied may be converted into heat, increasing wear and power consumption, and thus require thermal management parts.

Real-time closed loop control has been proposed to address these inefficiencies in operating LEDs having a wide range of forward voltages. In previous schemes, a current flowing through an LED is detected, and a bias voltage supplied to the LED is adjusted in response to the detected current automatically and at all times current flows through the circuit. For example, two previous schemes are illustrated in FIG. 1B (Prior Art). In each of these schemes, the bias voltage supplied by the power stage 3 is continually adjusted to provide a bias voltage having a first component equal to $V_{min}$.

While these previous schemes improve efficiency in some circumstances, the adjustment of the bias voltage to a stable state is limited by the electric circuit response time (i.e., the time it takes from bias voltage adjustment start to output stabilized). Generally, the power stage of the previous schemes determines the response time. The response time for previously proposed schemes has been as fast as approximately 1 millisecond. An exemplary power stage is shown in FIG. 1C (Prior Art), and a plot of voltage versus time is shown in FIG. 1D (Prior Art). The plot shown in FIG. 1D is from a simulation of real-time closed loop control using the power stage shown in FIG. 1C. In the simulation, the bias voltage was stepped up from 24 volts to 28 volts and stepped down from 28 volts to 24 volts. The response time 4 associated with the step up in voltage was observed to be 0.931 milliseconds. The response time 5 associated with the step down in voltage was observed to be 1 millisecond.

In some applications, it is desirable to supply pulses of current to the LED in order to cause the LED to flash on and off. In many such applications, the length of each pulse may be very short (e.g., less than 300 microseconds). In applications having pulses shorter than the response time of the circuit (e.g., as short as 300 microseconds or less), the previously proposed schemes do not work because the response time is too long. That is, each pulse of current terminates before the bias voltage supplied to the LED can be changed and stabilized. Attempting to implement the previously proposed schemes in applications with short pulse width (e.g., less than 300 microseconds) causes unexpected changes in voltage and/or instability in the system.

BRIEF SUMMARY

At a high level, the present application is generally directed to improved systems and methods of operating a constant current LED pulsing drive circuit supplied with narrow constant current pulses. The narrow constant current pulses may be shorter than a response time of the constant current LED pulsing drive circuit (e.g., less than 300 microseconds). The constant current LED pulsing drive circuit may include a pulsed constant current source. The constant current LED pulsing drive circuit may include a series of one or more LEDs supplied with a bias voltage that biases the series of one or more LEDs. The bias voltage may be tuned periodically (e.g., after a time interval has elapsed or at a special event such as power-up or reset) for forward voltage variations, regardless of their sources.

Tuning the bias voltage may comprise the steps of: (A) setting the bias voltage to a test value, the test value being at least equal to the sum of the bias voltage second component and the maximum forward voltage rating of each of the one or more LEDs; (B) measuring an intermediate voltage present between the series of one or more LEDs and the constant current source when the LEDs are turned on; (C) determining if the intermediate voltage exceeds the second component of the bias voltage; and (D) upon determining the intermediate voltage exceeds the second component of the bias voltage, reducing the bias voltage applied to the one or more LEDs by an amount necessary to cause the intermediate voltage to equal the second component of the bias voltage.

Additional objects, advantages, and novel features of the invention will be set forth in part in the description that follows, and in part will become apparent to those skilled in the art upon examination of the following, or may be learned by practice of the invention.

BRIEF DESCRIPTION OF THE DRAWINGS

Exemplary embodiments of the present invention are described in detail herein with reference to the attached drawing figures, which are incorporated herein by reference, wherein.

DETAILED DESCRIPTION

Figure 1A:
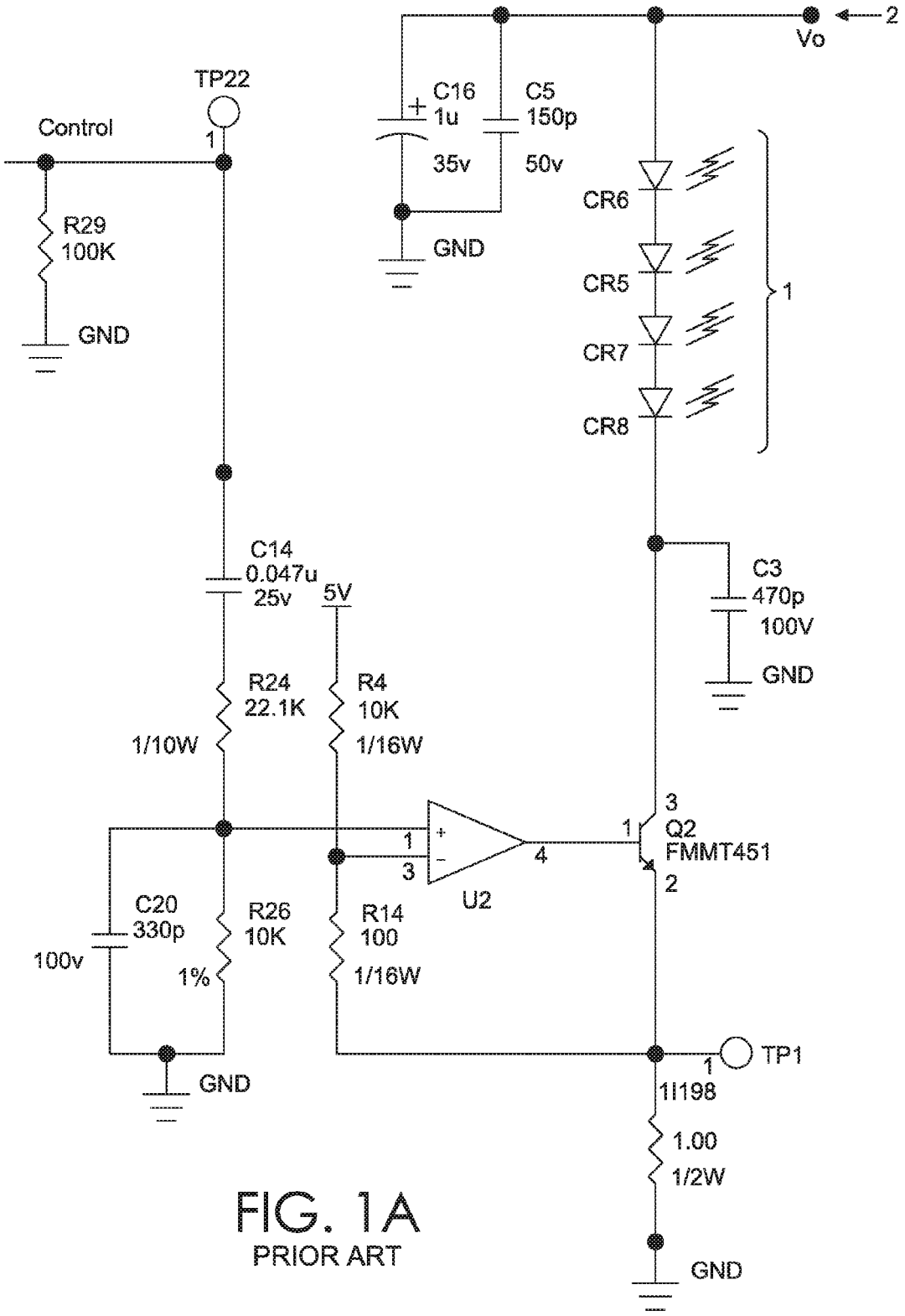
FIG. 1A PRIOR ART
FIG. 1A depicts a prior art pulsing drive circuit with a fixed voltage supply.
Figure 1B:
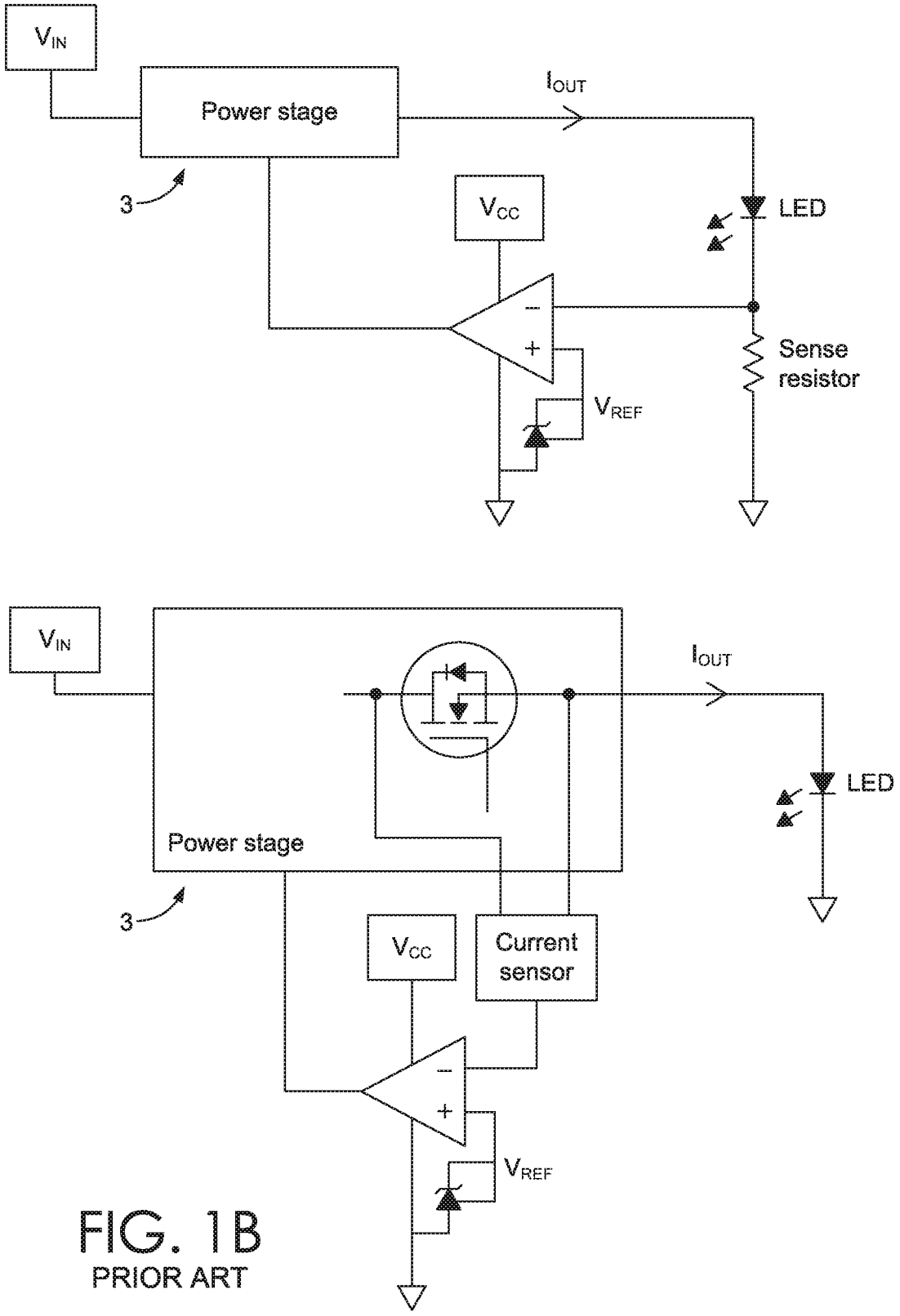
FIG. 1B PRIOR ART
FIG. 1B depicts two prior art schemes providing real-time closed loop control of bias voltage supplied to an LED.
Figure 1C:
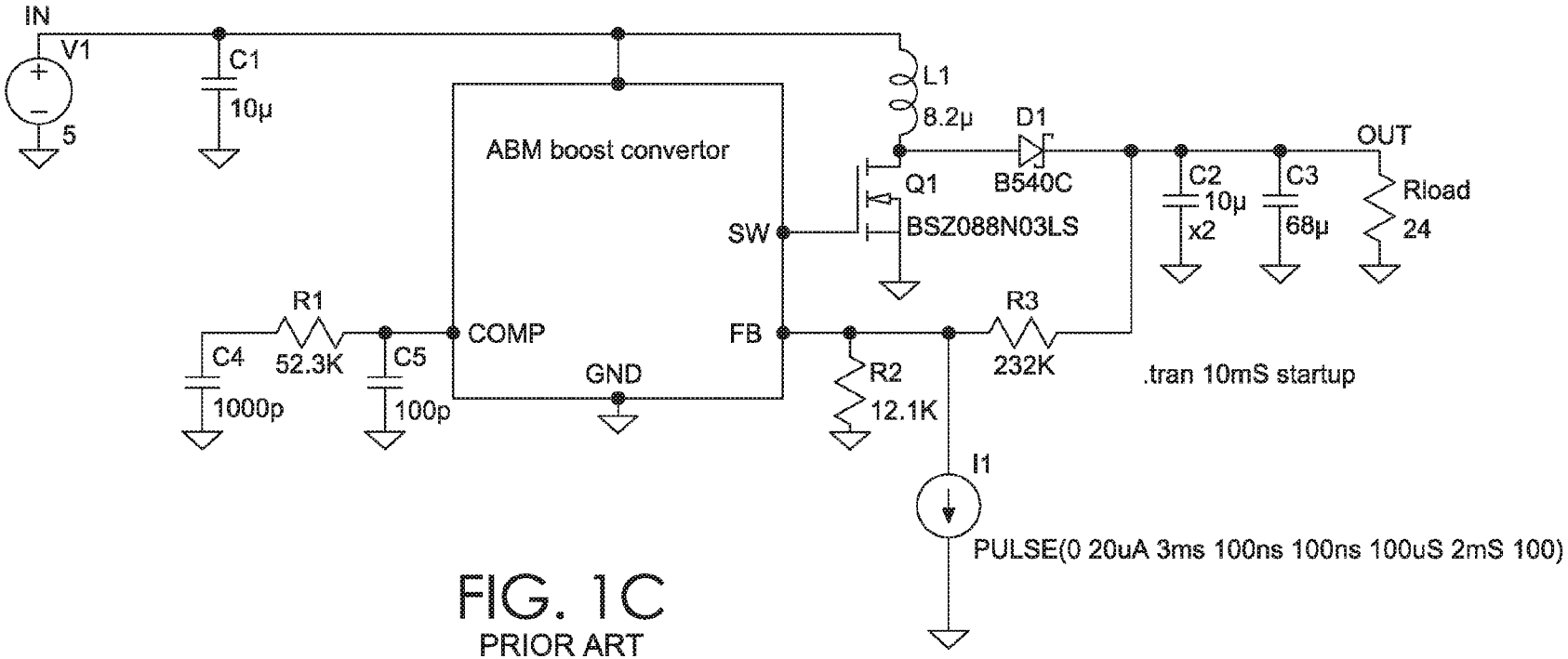
FIG. 1C PRIOR ART
FIG. 1C depicts a prior art exemplary power stage used in prior art schemes for providing real-time closed loop control of bias voltage supplied to an LED.
Figure 1D:
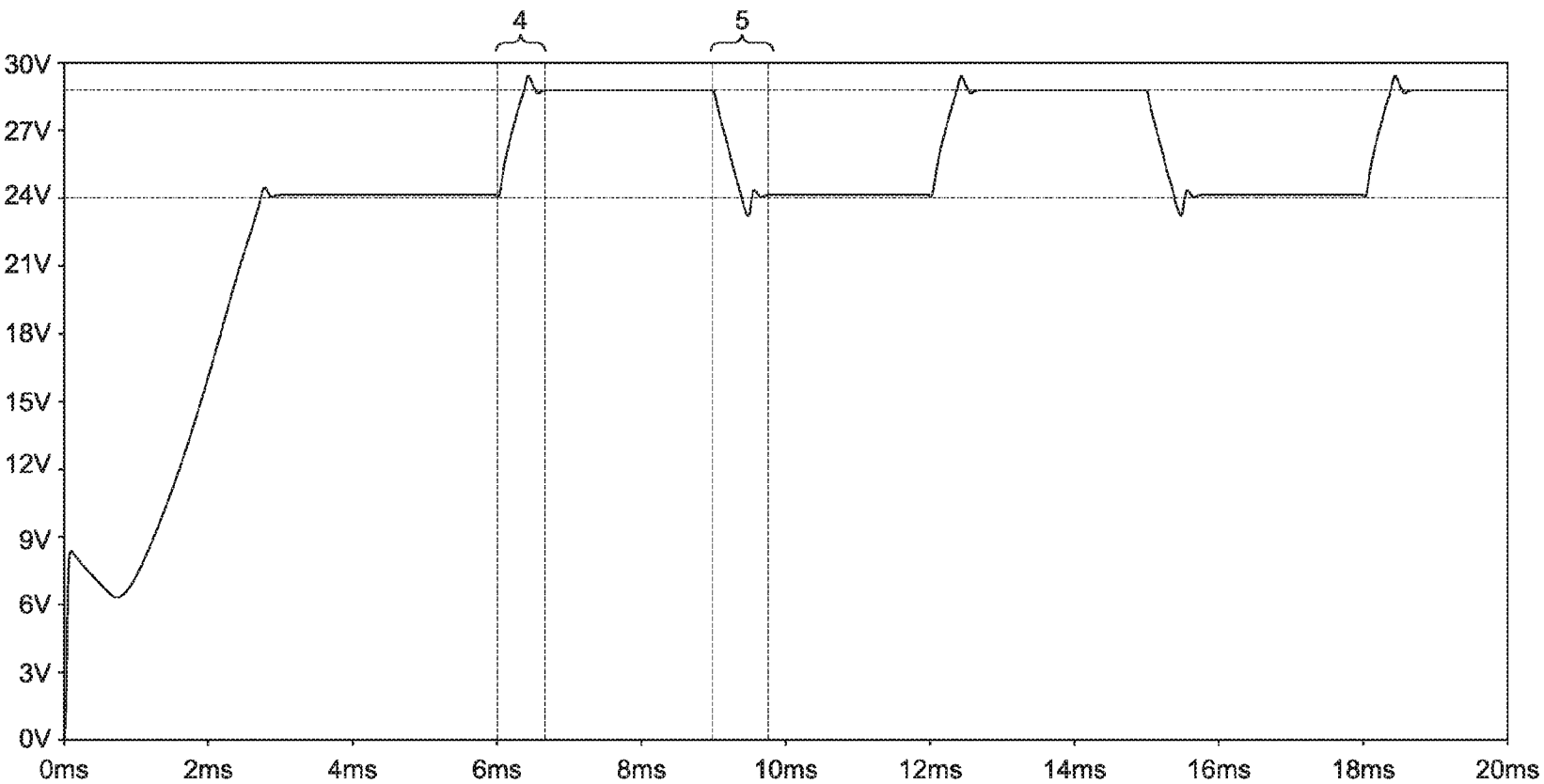
FIG. 1D PRIOR ART
FIG. 1D depicts a prior art plot of voltage versus time from a simulation of real-time closed loop control using the power stage shown in FIG. 1C.

Subject matter is described throughout this disclosure in detail and with specificity in order to meet statutory requirements. But the aspects described throughout this disclosure are intended to be illustrative rather than restrictive, and the description itself is not intended necessarily to limit the scope of the claims. Rather, the claimed subject matter might be practiced in other ways to include different elements or combinations of elements that are equivalent to the ones described in this disclosure. In other words, the intended scope of the invention includes equivalent features, aspects, materials, methods of construction, and other aspects in embodiments not expressly described or depicted in this application in the interests of concision, but which would be understood by an ordinarily skilled artisan in the relevant art in light of the full disclosure provided herein as being included within the inventive scope. It will be understood that certain features and subcombinations are of utility and may be employed without reference to other features and subcombinations. This is contemplated by and is within the scope of the claims.

At a high level, the present application is generally directed to improved systems and methods of operating a constant current LED pulsing drive circuit supplied with narrow constant current pulses. The narrow constant current pulses may be shorter than a response time of the constant current LED pulsing drive circuit (e.g., less than 300 microseconds). The constant current LED pulsing drive circuit may include a pulsed constant current source. The constant current LED pulsing drive circuit may include a series of one or more LEDs supplied with a bias voltage that biases the series of one or more LEDs. The bias voltage may be tuned periodically (e.g., after a time interval has elapsed or at a special event such as power-up or reset) for forward voltage variations, regardless of their sources.

Tuning the bias voltage may comprise the steps of: (A) setting the bias voltage to a test value, the test value being at least equal to the sum of the bias voltage second component and the maximum forward voltage rating of each of the one or more LEDs; (B) measuring an intermediate voltage present between the series of one or more LEDs and the constant current source when the LEDs are turned on; (C) determining if the intermediate voltage exceeds the second component of the bias voltage; and (D) upon determining the intermediate voltage exceeds the second component of the bias voltage, reducing the bias voltage applied to the one or more LEDs by an amount necessary to cause the intermediate voltage to equal the second component of the bias voltage.

One aspect disclosed herein is directed to a constant current LED pulsing drive circuit. The constant current LED pulsing drive circuit may include a voltage supply configured to supply a bias voltage to one or more LEDs in series with the voltage supply. Each of the one or more LEDs may have a first drive voltage requirement necessary for lighting each of the one or more LEDs. The drive voltage requirement may be within a range of forward voltages and between a minimum forward voltage and a maximum forward voltage. The constant current LED pulsing drive circuit may also include one or more other components in series with the one or more LEDs. The one or more other components may have a second drive voltage requirement. The constant current LED pulsing drive circuit may also include a controller. The controller may be configured to control pulses of current moving through the one or more LEDs. In some aspects, each of the pulses lasts less than 300 microseconds. The constant current LED pulsing drive circuit may also include a sensor configured to detect an intermediate voltage of the constant current LED pulsing drive circuit at a node between the one or more LEDs and the one or more other components and, based upon the intermediate voltage, cause a signal to be sent to adjust the bias voltage.

The voltage supply may include a direct current to direct current voltage converter (hereinafter "DC/DC converter") configured to adjust the bias voltage. The DC/DC converter may include an input voltage lead, an output voltage lead, and a feedback voltage lead. The input voltage lead may be configured to receive an input voltage, the output voltage lead may be configured to supply the bias voltage, and the feedback voltage lead may be configured to receive a feedback voltage for adjusting the bias voltage.

The sensor may include an analog to digital converter, a processor, and one of a digital to analog converter and a pulse-width modulator. The analog to digital converter may have an intermediate voltage lead configured to receive the intermediate voltage and communicate a first digital signal corresponding to the intermediate voltage to the processor. The processor may be configured to receive the first digital signal and determine if the intermediate voltage is higher than the second drive voltage requirement. The processor may also be configured to send a second digital signal to one of the digital to analog converter and the pulse-width modulator upon determining the intermediate voltage is higher than the second drive voltage requirement. Each of the digital to analog converter and the pulse-width modulator may be configured to receive the second digital signal and supply the feedback voltage to the DC/DC converter to reduce the bias voltage by an amount necessary to cause the intermediate voltage to equal the second drive voltage requirement. The processor may be one of a microprocessor unit and a microcontroller unit.

In some aspects, the one or more LEDs may comprise a first series of one or more LEDs, the one or more other components in series with the one or more LEDs may comprise a first array of one or more other components in series with the first series of one or more LEDs, the controller may comprise a first controller, the node may comprise a first node, and the intermediate voltage may comprise a first intermediate voltage. The constant current LED pulsing drive circuit may further include a second series of one or more LEDs in parallel with the first series of one or more LEDs. The second series of one or more LEDs may be configured to receive the bias voltage supplied by the voltage supply. Each LED of the second series of one or more LEDs may have a third drive voltage requirement being within a range of forward voltages between a minimum forward voltage and a maximum forward voltage. The constant current LED pulsing drive circuit may further include a second array of one or more other components in series with the second series of one or more LEDs. The second array of one or more other components may have a fourth drive voltage requirement. The constant current LED pulsing drive circuit may further include a second controller configured to control pulses of current passing through the second series of one or more LEDs. In some aspects, each of the pulses lasts less than 300 microseconds. The sensor may be further configured to detect a second intermediate voltage of the constant current LED pulsing drive circuit at a second node between the second series of one or more LEDs and the second array of one or more other components. Based in part upon the first intermediate voltage and in part upon the second intermediate voltage, the sensor may be configured to send a signal to adjust the bias voltage.

The sensor may include an analog to digital converter, a processor, and one of a digital to analog converter and a pulse-width modulator. The analog to digital converter may have a first intermediate voltage lead configured to receive the first intermediate voltage and communicate a first digital signal corresponding to the intermediate voltage to the processor. The analog to digital converter may have a second intermediate voltage lead configured to receive the second intermediate voltage and communicate a second digital signal corresponding to the intermediate voltage to the processor. The processor may be configured to receive the first digital signal and the second digital signal and determine (A) a first voltage difference between the first intermediate voltage and the second drive voltage requirement, and (B) a second voltage difference between the second intermediate voltage and fourth drive voltage requirement. Upon determining the first voltage difference and the second voltage difference, the processor may be configured to send a third digital signal corresponding to the lower of the first voltage difference and the second voltage difference to the digital to analog converter. The digital to analog converter may be configured to receive the third digital signal and supply the feedback voltage to the DC/DC converter to reduce the bias voltage by an amount necessary to zero out the lower of the first voltage difference and the second voltage difference.

Another aspect disclosed herein is directed to a method of operating a constant current LED pulsing drive circuit. The method may include operating a constant current LED pulsing drive circuit for a first period of time, subsequent to the first period of time, determining a minimum bias voltage required for the constant current LED pulsing drive circuit based on a forward voltage across a series of one or more LEDs, adjusting an initial bias voltage applied to the series of one or more LEDs to the minimum voltage required for the constant current LED pulsing drive circuit, and subsequent to adjusting the initial bias voltage supplied, operating the constant current LED pulsing drive circuit for a second period of time.

Operating the constant current LED pulsing drive circuit may comprise supplying pulsed currents to the constant current LED pulsing drive circuit. Each of the pulsed currents may have less than a 300 microsecond duration. In some aspects, each of the pulsed currents has a duration between 10 and 100 microseconds. The bias voltage required for the constant current LED pulsing drive circuit includes a first voltage portion and a second voltage portion. The first voltage portion may be the voltage necessary for driving the series of one or more LEDs. The second voltage portion may be the voltage necessary for driving the other components of the constant current LED pulsing drive circuit.

Each of the one or more LEDs may have an individual forward voltage. Each of the individual forward voltages may be within a range of forward voltages associated with each respective LED. The range of forward voltages includes a maximum forward voltage necessary for driving the respective LED.

The step of determining the minimum voltage required for the constant current LED pulsing drive circuit based on a forward voltage across the series of one or more LEDs may comprise setting the initial bias voltage applied to the series of one or more LEDs to a test value. The test value may be at least equal to the sum of the second voltage portion and the maximum forward voltage of each of the one or more LEDs. Said step of determining the minimum forward voltage may further comprise measuring an actual forward voltage across the series of one or more LEDs. Said step of determining the minimum forward voltage may further comprise determining an adjustment voltage based upon the measured actual forward voltage across the series of one or more LEDs. Said step of determining the minimum forward voltage may further comprise subtracting the adjustment voltage from the test value to obtain the minimum bias voltage.

Yet another aspect disclosed herein is directed to one or more computer-readable media having computer-executable instructions thereon that, when executed by one or more processors, cause the one or more processors to perform a method of periodically tuning a bias voltage supplied to a constant current LED pulsing drive circuit having one or more LEDs in series. Each of the one or more LEDs has a variable forward voltage that is less than a maximum forward voltage rating. Each of the pulsed currents supplied to the constant current LED pulsing drive circuit lasts less than 300 microseconds.

The method of tuning the bias voltage supplied may comprise sending a first indication to set a bias voltage applied to the one or more LEDs to a test value, the test value being at least equal to a sum of a secondary drive voltage necessary to drive other components of the constant current LED pulsing drive circuit and the maximum forward voltage rating of each of the one or more LEDs. The method may further comprise, from a node positioned between the one or more LEDs and the other components, receiving a voltage measurement from the node to ground. The method may further comprise determining if the voltage measurement is greater than the secondary drive voltage. The method may further comprise upon determining that the voltage measurement is greater than the secondary drive voltage, sending a second indication to reduce the bias voltage supplied to the constant current LED pulsing drive circuit to reduce the voltage from the node to ground to the secondary drive voltage.

The voltage measurement may comprise a voltage received by an analog to digital converter that converts the voltage into a digital signal. The bias voltage applied to the one or more LEDs is adjustable by a DC/DC converter configured to increase and decrease the bias voltage applied in response to the first indication and the second indication, respectively. In some aspects, the second indication may comprise a digital signal sent to a digital to analog converter configured to supply a feedback voltage to the DC/DC converter in response to the digital signal. In other aspects, the second indication may comprise a digital signal sent to a pulse-width modulator configured to supply a feedback voltage to the DC/DC converter in response to the digital signal.

Figure 2:
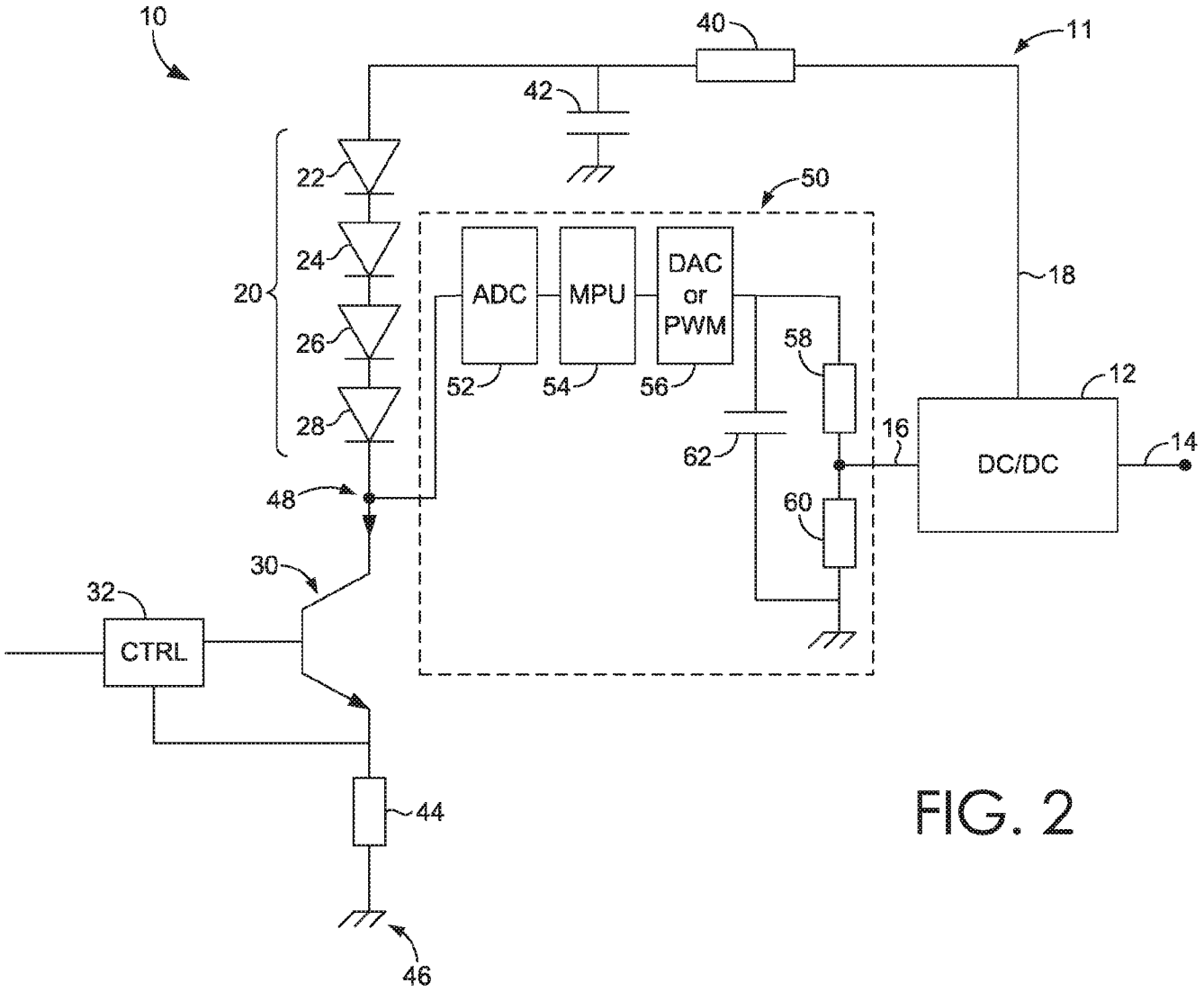
FIG. 2 depicts an exemplary constant current LED pulsing drive circuit, in accordance with an aspect hereof.

Turning now to FIG. 2, an exemplary aspect of a constant current LED pulsing drive circuit 10 is illustrated. The illustrated constant current LED pulsing drive circuit 10 includes a main section 11 and a sensor section 50. The main section 11 may include a DC/DC converter 12 in series with one or more LEDs 20. The main section 11 may also include a constant current source 30 in series with the one or more LEDs 20. In other aspects, the main section 11 may include other components such as a transistor or a sampling element.

The DC/DC converter 12 may include a voltage input lead 14 configured to receive a voltage from a voltage source. The DC/DC converter 12 shown in FIG. 2 includes a feedback voltage lead 16 and an output voltage lead 18. The feedback voltage lead 16 may be configured to receive a feedback voltage. The DC/DC converter 12 may be configured to supply a bias voltage through the output voltage lead 18 to the one or more LEDs 20. The DC/DC converter 12 may receive the feedback voltage to adjust the bias voltage to a suitable value.

The one or more LEDs 20 may include any number of LEDs. For example, the illustrated constant current LED pulsing drive circuit 10 has a first LED 22, a second LED 24, a third LED 26, and a fourth LED 28. In other aspects, the one or more LEDs 20 may include more than four LEDs or less than four LEDs. The main section 11 may include a first resistor 40 in series with the DC/DC converter 12. In some aspects, the first resistor 40 may be between the DC/DC converter 12 and the one or more LEDs 20. The main section 11 may also include a first capacitor 42 that may connect to the main section 11 between the DC/DC converter 12 and the one or more LEDs 20.

Each LED of the one or more LEDs 20 has a $V_{min}$ that must be supplied to drive the respective LED. The $V_{min}$ is between a range of forward voltages. The range of forward voltages includes a minimum forward voltage rating and a maximum forward voltage rating. In some aspects, the minimum forward voltage rating is 1.7 volts and the maximum forward voltage rating is 3.4 volts.

The constant current LED pulsing drive circuit 10 may include a node 48 between the one or more LEDs 20 and other components of the constant current LED pulsing drive circuit 10. In the illustrated aspect, the node 29 is between the one or more LEDs 20 and the constant current source 30.

In the illustrated aspect of the constant current LED pulsing drive circuit 10, the constant current source 30 is in series with the one or more LEDs 20. In other aspects, other components may be connected to the constant current LED pulsing drive circuit 10. The other components may be in series with the one or more LEDs 20, in accordance with some aspects. For example, a second resistor 44 may be in series with the constant current source 30 and one or more LEDs 20. Some of the components shown in FIG. 2 may be a simplified representation of multiple components. For example, the second resistor 44 is shown as a single resistor, but one of ordinary skill in the art will appreciate that this may be multiple series resistors that are illustrated as a single resistor. In addition, the constant current LED pulsing drive circuit 10 may include other components, which are not shown in FIG. 2. A controller 32 may control the supply of pulses of current passing through the constant current LED pulsing drive circuit 10.

In some aspects, the main section 11 may terminate at a relative ground 46. The constant current LED pulsing drive circuit 10 requires a bias voltage to operate. The bias voltage comprises at least the forward voltage of the one or more LEDs 20 (i.e., a voltage drop from the DC/DC converter 12 to the node 48) and the voltage across the other components of the constant current LED pulsing drive circuit 10 (i.e., a voltage drop from the node 48 to the relative ground 46).

The sensor section 50 may comprise a sensing and control circuit. The sensor section 50 may connect to the main section 11 at the node 48. The sensor section 50 may also connect to the main section 11 at the voltage feedback lead 16 of the DC/DC converter 12. The sensor section 50 may include an analog to digital converter 52. The analog to digital converter 52 may be configured to receive an intermediate voltage of the main section 11 associated with the node 48. The analog to digital converter 52 may be configured to convert the intermediate voltage into a first digital signal corresponding to the intermediate voltage and communicate the first digital signal to a processor 54.

The processor 54 may be configured to receive the first digital signal. Upon receiving the first digital signal, the processor 54 may be configured to determine a difference between the intermediate voltage and the second component of the bias voltage. If the intermediate voltage exceeds the second component of the bias voltage, then the processor 54 may be configured to send a second digital signal to a feedback voltage supply 56. In some aspects, the processor 54 is a microprocessor. In other aspects, the processor 54 comprises a microcontroller. The processor 54 may be dedicated to the sensor section 50 or may be a shared component of another device or computer system (such as a computer system 100 discussed below).

The feedback voltage supply 56 may comprise a digital to analog converter, in accordance with some aspects. In other aspects, the feedback voltage supply 56 comprises a pulse-width modulator. The feedback voltage supply 56 may be configured to receive the second digital signal and supply a feedback voltage corresponding to the second digital signal to the DC/DC converter 12 through the feedback voltage lead 16. In some aspects, the sensor section 50 may include a voltage divider having a third resistor 58 and a fourth resistor 60, each in series with the feedback voltage supply 56. In these aspects, the feedback voltage lead 16 may connect to the sensor section 50 between the third resistor 58 and the fourth resistor 60. In other aspects, the sensor section 50 may also include a second capacitor 62 connected in parallel to the voltage divider.

In operation, the DC/DC converter 12 may set the bias voltage applied to the one or more LEDs 20 to a test value. The test value may be at least the sum of the second component of the bias voltage and the maximum forward voltage rating of each of the LEDs of the one or more LEDs 20. For example, if there are four LEDs in the series of one or more LEDs 20 and each is rated with a maximum forward voltage of 3.5 volts, and the second component of the bias voltage is 1.7 volts, then the test value would be set to at least 15.7 volts (i.e., the test value at least equal to 1.7+(4×3.5)=15.7).

The sensor section 50 then measures the intermediate voltage at the node 48, and the processor 54 determines if the intermediate voltage exceeds the second portion of the bias voltage. Continuing with the preceding example, if the intermediate voltage at the node 48 is measured at 5.7 volts, the processor 54 would determine that the intermediate voltage of 5.7 volts exceeds the second portion of the bias voltage of 1.7 volts.

If the intermediate voltage exceeds the second portion of the bias voltage, then the sensor section 50 provides the feedback voltage to the DC/DC converter 12 necessary to reduce the bias voltage by an amount necessary to cause the intermediate voltage to equal the second portion of the bias voltage. Continuing still with the preceding example, having determined the intermediate voltage (5.7 volts) exceeds the second portion of the bias voltage (1.7 volts), the sensor section 50 would provide the feedback voltage necessary for reducing the bias voltage by an amount necessary to cause the intermediate voltage to equal the second portion of the bias voltage (i.e., 4.0 volts).

The feedback voltage needed to reduce the bias voltage by an amount necessary to cause the intermediate voltage to equal the second portion of the bias voltage may be determined in a plurality of ways. In some aspects, the feedback voltage is manually adjusted incrementally and the sensor section 50 determines if the intermediate voltage continues to exceed the second portion of the bias voltage at each increment until the proper feedback voltage is determined. In other aspects, the feedback voltage may be calculated based upon the relative resistance of each of the components of the main section 11.

The bias voltage supplied to the one or more LEDs 20 is only adjusted periodically, in accordance with some aspects. Continuing still with the preceding example, the bias voltage may be maintained at 11.7 volts until a predetermined time interval has expired. In some aspects, the sensor section 50 may continually supply the determined feedback voltage to the DC/DC converter 12 for predetermined time intervals and may only adjust the bias voltage by changing the feedback voltage when the time interval expires or at special events such as power-up or reset. For example, the bias voltage supplied to the series of one or more LEDs 20 may only be adjusted at power-up and every 12 hours thereafter, or any reset therebetween.

Figure 3:
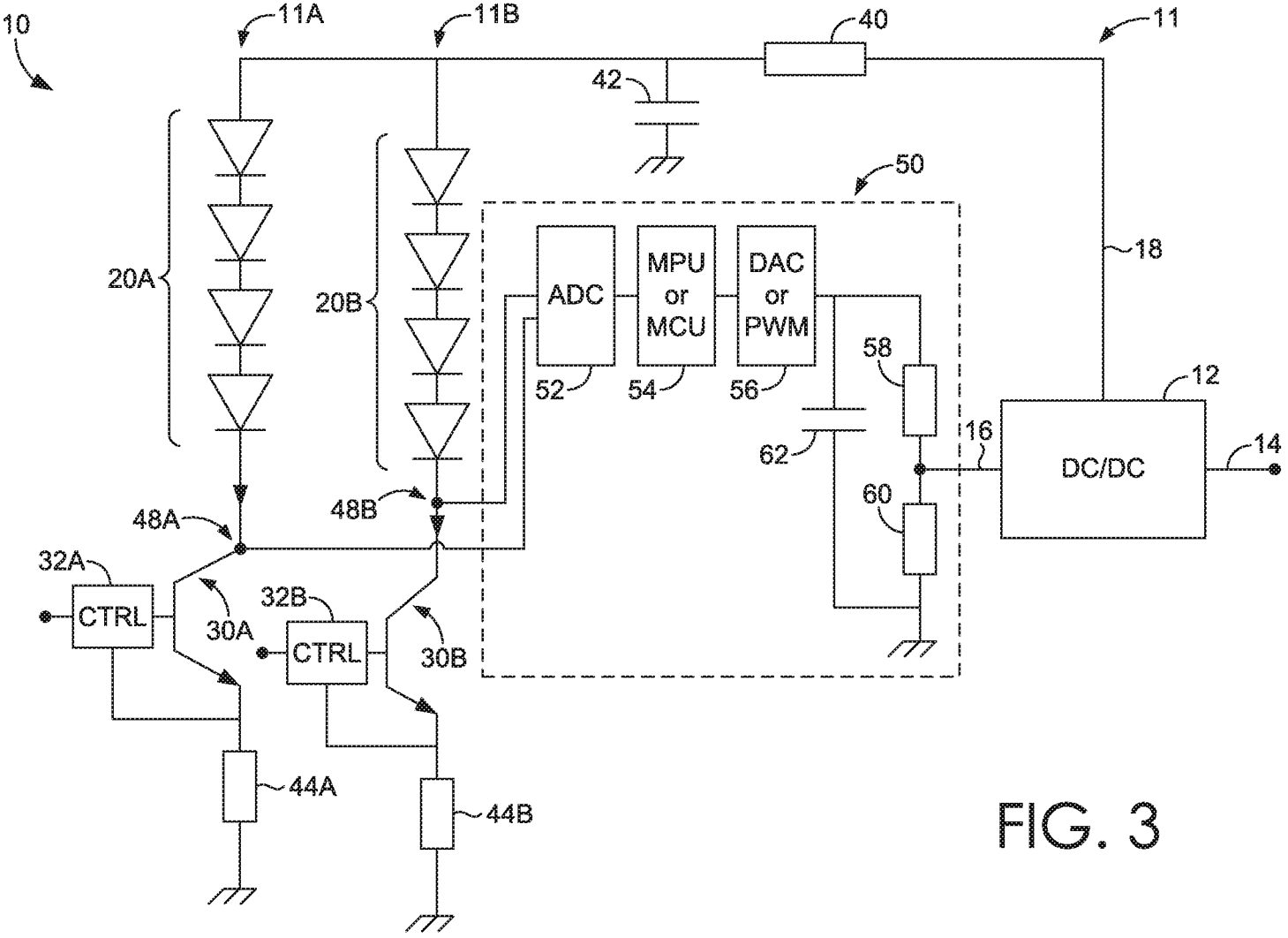
FIG. 3 depicts an exemplary constant current LED pulsing drive circuit having multiple LED strings, in accordance with an aspect hereof.

Referring to FIG. 3, the main section 11 may include a plurality of series of one or more LEDs in parallel with one another. For example, the main section 11 illustrated in FIG. 3 includes a first series of one or more LEDs 20A and a second series of one or more LEDs 20B. Hence, the main section 11 may have a plurality of parallel strings branching off from the DC/DC converter 12 (or from some other common voltage supply), and each string may be supplied a common bias voltage. Each of the plurality of parallel strings may be similar to the respective portion of the main section 11 described above in reference to FIG. 2. Hence, each of the plurality of parallel strings may include a constant current source in series with a respective series of one or more LEDs. In some aspects, each of the plurality of parallel strings may also include other components in series with the respective series of one or more LEDs. Each of the plurality of parallel strings may terminate at a relative ground.

The main section 11 illustrated in FIG. 3 includes a first string 11A and a second string 11B. The first string 11A may include a first series of one or more LEDs 20A, a first constant current source 30A in series with the first series of one or more LEDs 20A, and a first node 48A between the first series of one or more LEDs 20A and the first constant current source 30A. In some aspects, the first string 11A may include other components, such as resistor 44A. Pulses of current passing through the first string 11A may be controlled by a first controller 32A. The first constant current source 30A and the other components may be collectively referred to as a first array of other components. The first array of other components may have a second drive voltage requirement. The second string 11B may include a second series of one or more LEDs 20B, a second constant current source 30B in series with the second series of one or more LEDs 20B, and a second node 48B between the second series of one or more LEDs 20B and the second constant current source 30B. In some aspects, the second string 11B may include other components, such as resistor 44B. Pulses of current passing through the second string 11B may be controlled by a second controller 32B. In some aspects, a common controller may control the pulses of current passing through both the first string 11A and the second string 11B. The second constant current source 30B and the other components of the second string 11B may be collectively referred to as a second array of other components. The second array of other components may have a fourth drive voltage requirement.

The sensor section 50 may have a connection to each of the plurality of parallel strings of the main section 11. For example, the sensor section 50 may connect to the first node 48A and to the second node 48B and may be configured to measure an intermediate voltage for each of the first string 11A and the second string 11B at the first node 48A and the second node 48B, respectively.

The bias voltage supplied to the each of the plurality of strings of the main section 11 may comprise a first component and a second component. The first component may comprise a largest forward voltage of one of the series of one or more LEDs (i.e., the largest voltage drop across the series of one or more LEDs of one of the strings of the main section 11). The second component may comprise a voltage drop across the other components (i.e., other than the series of one or more LEDs) of the strings. In some aspects, the voltage drop across the other components may be the same for each string.

In some aspects, the sensor section 50 may be configured to transmit only a single first digital signal to the processor 54, which corresponds to the lowest of the intermediate voltages measured. In such aspects, the remainder of the operation of the constant current LED pulsing drive circuit 10 is the same as discussed above in reference to the configuration illustrated in FIG. 2.

In other aspects, the sensor section 50 may be configured to transmit a first digital signal for each of the intermediate voltages measured to the processor 54. In these aspects, the processor 54 is configured to determine the smallest difference between each of the intermediate voltages measured and the second component of the bias voltage. In these aspects, the processor 54 then sends a second digital signal corresponding to the smallest difference to the feedback voltage supply 56. In these aspects, the remainder of the tuning process may be the same as discussed above in reference to the configuration illustrated in FIG. 2.

For example, in the configuration illustrated in FIG. 3, if the difference between the intermediate voltage measured at the first node 48A and the second component of the bias voltage is determined to be 4.0 volts and the difference between the intermediate voltage measured at the second node 48B and the second component of the bias voltage is determined to be 6.0 volts, then the processor 54 would send the second digital signal to the feedback voltage supply 56 that corresponds to a feedback voltage necessary to reduce the bias voltage by an amount necessary to zero out (i.e., reduce to zero) the smaller difference (i.e., 4.0 volts).

Figure 4:
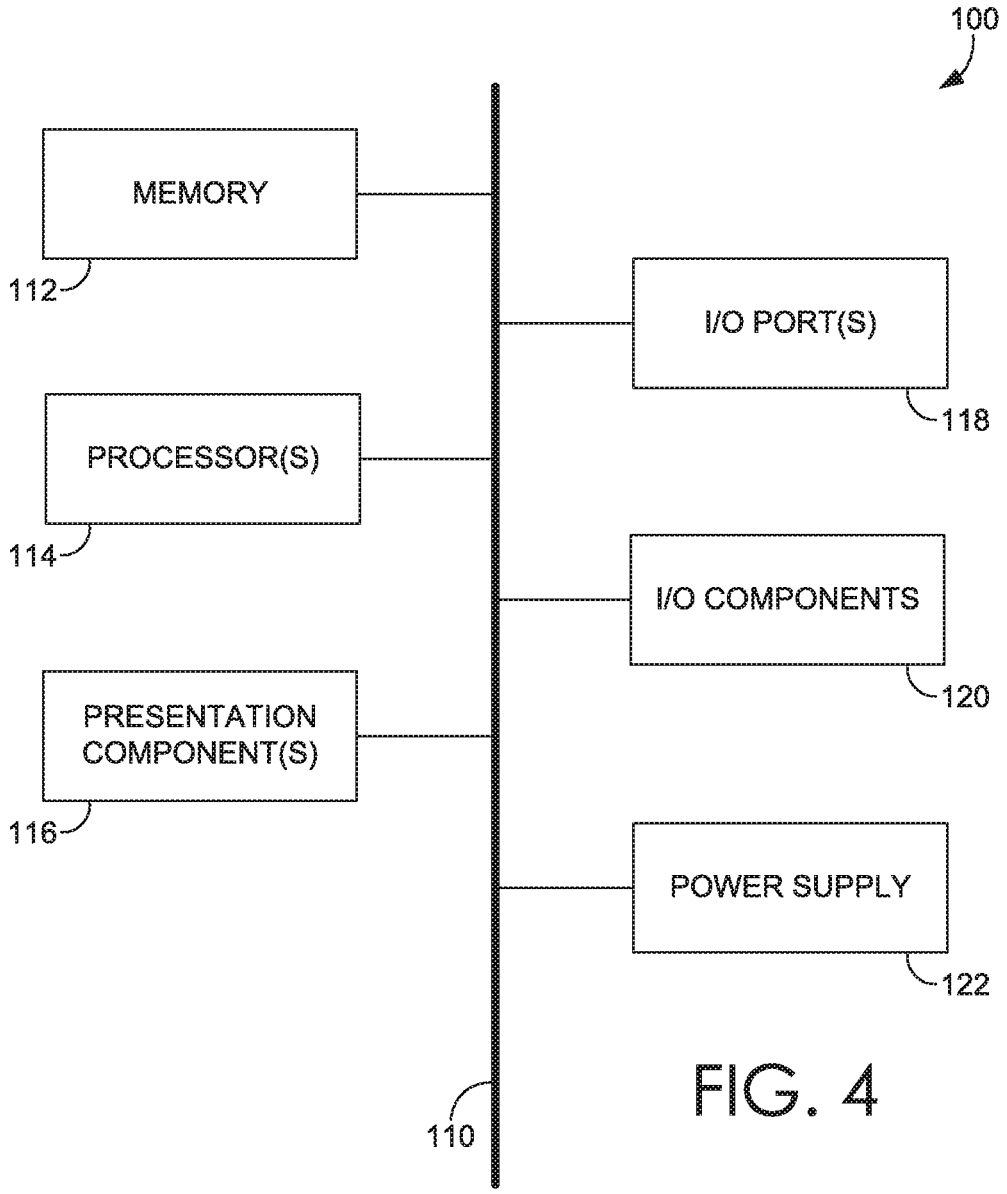
FIG. 4 depicts an exemplary computer system, in accordance with an aspect hereof.

The technology herein described may comprise, among other things, a constant current LED pulsing drive circuit, a system, a method, or a set of instructions stored on one or more computer-readable media. Information stored on the computer-readable media may be used to direct operations of a computing device, and an exemplary computing device 100 is depicted in FIG. 4. The computing device 100 is but one example of a suitable computing system and is not intended to suggest any limitation as to the scope of use or functionality of inventive aspects hereof. Neither should the computing system 100 be interpreted as having any dependency or requirement relating to any one or combination of components illustrated. Moreover, aspects of the invention may also be practiced in distributed computing systems where tasks are performed by separate or remote-processing devices that are linked through a communications network.

The computing device 100 has a bus 110 that directly or indirectly couples the following components: memory 112 (which may include memory chips or other local memory structures), one or more processors 114 (which may include the processor 54 and a programmable logic controller), one or more presentation components 116, input/output (I/O) ports 118 (which may include the analog to digital converter 52 and/or the feedback voltage supply 56), 1/O components 120, and an illustrative power supply 122. The bus 110 represents what may be one or more busses (such as an address bus, data bus, or combination thereof). In some aspects not illustrated in FIG. 4, the analog to digital converter 52 and/or the feedback voltage supply 56 (such as the digital to analog converter or pulse-width modulator) may be coupled directly or indirectly to the bus 110 and included as components of the computing device 100. Although the various blocks of FIG. 4 are shown with lines for the sake of clarity, in reality, delineating various components is not so clear, and metaphorically, the lines would more accurately be grey and fuzzy. For example, processors may have memory. Further, it will be understood by those of ordinary skill in the art that not all computing devices contemplated for use with aspects hereof may utilize all components illustrated.

The computing device 100 typically includes a variety of computer-readable media. Computer-readable media can be any available media that can be accessed by the computing system 100 and includes both volatile and nonvolatile media, removable and non-removable media. By way of example, and not limitation, computer-readable media may comprise computer storage media and communication media, computer storage media excluding signals per se. Computer storage media includes volatile and nonvolatile, removable and non-removable media implemented in any method or technology for storage of information such as computer-readable instructions, data structures, program modules, or other data.

Computer storage media includes, by way of example, and not limitation, Random Access Memory (RAM); Read-Only Memory (ROM); Electronically Erasable Programmable Read-Only Memory (EEPROM); flash memory or other memory technologies; CD-ROM, digital versatile disks (DVD) or other optical or holographic media; magnetic cassettes, magnetic tape, magnetic disk storage, or other magnetic storage devices. Computer storage media does not comprise a propagated data signal.

Communication media typically embodies computer-readable instructions, data structures, program modules, or other data in a modulated data signal, such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above should also be included within the scope of communication media.

The computing device 100 is depicted to have one or more processors 114 that read data from various entities such as memory 112 or I/O components 120. Exemplary data that is read by a processor may be comprised of computer code or machine-useable instructions, which may be computer-executable instructions such as program modules, being executed by a computer or other machine. Generally, program modules such as routines, programs, objects, components, data structures, etc., refer to code that perform particular tasks or implement particular abstract data types.

The presentation components 116 present data indications to a user or other device. Exemplary presentation components are a display device, speaker, printing component, light-emitting component, etc. The I/O ports 118 allow the computing device 100 to be logically coupled to other devices including the I/O components 120, some of which may be built in.

In the context of operating a constant current LED pulsing drive circuit, a computing device 100 may be used to tune the adjustable voltage supplied to the series of one or more LEDs 20. For example, a computing device may be used to control a constant current LED pulsing drive circuit described herein.

Figure 5:
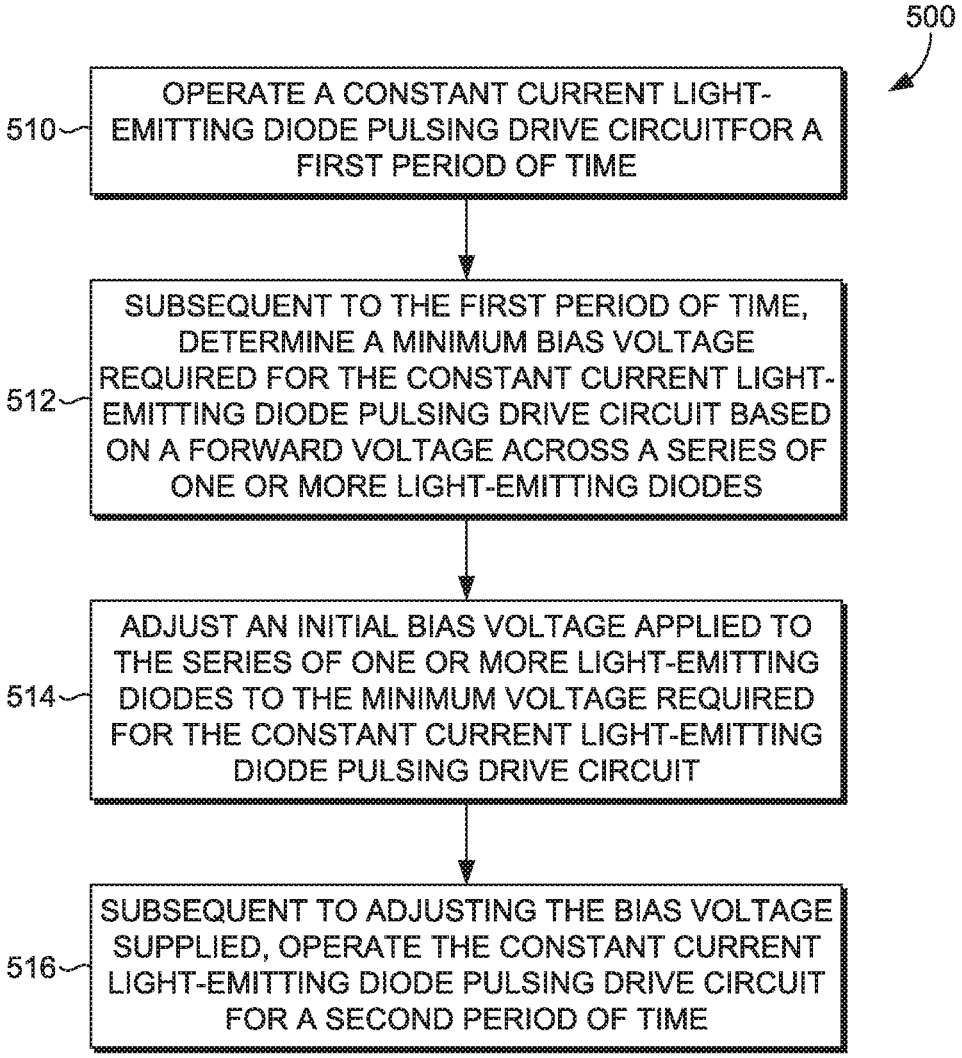
FIG. 5 depicts a method of operating a constant current LED pulsing drive circuit, in accordance with an aspect hereof.

Referring to FIG. 5, a method 500 of operating a constant current LED pulsing drive circuit is provided. The method 500 may include the step of operating the constant current LED pulsing drive circuit for a first period of time, as illustrated in block 510. Subsequent to the first period of time, the method 500 may also include determining a minimum bias voltage required for the constant current LED pulsing drive circuit based on a forward voltage across a series of one or more LEDs, as illustrated in block 512. The method 500 may also include the step of adjusting an initial bias voltage supplied to the series of one or more LEDs to the minimum bias voltage required for the constant current LED pulsing drive circuit, as illustrated in block 514. Subsequent to adjusting the bias voltage supplied, the method 500 may also include the step of operating the constant current LED pulsing drive circuit for a second period of time, as illustrated in block 516.

Figure 6:
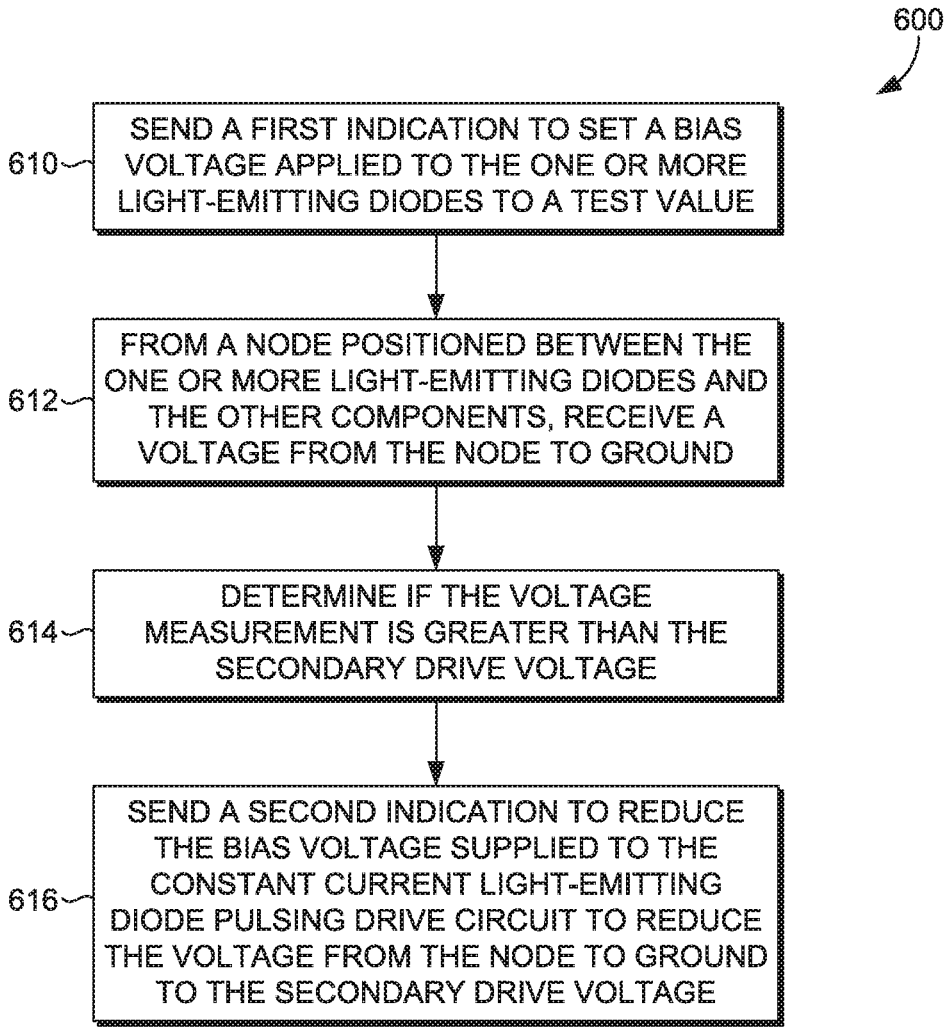
FIG. 6 depicts a method of tuning a bias voltage supplied to a constant current LED pulsing drive circuit, in accordance with an aspect hereof.

Referring to FIG. 6, a method 600 is depicted of periodically tuning a voltage supplied to a constant current LED pulsing drive circuit having one or more LEDs, wherein each of the LEDs has a variable forward voltage that is less than a maximum forward voltage rating and wherein each of the pulsed currents supplied to the constant current LED pulsing drive circuit lasts less than 300 microseconds. The method 600 may include the step of sending a first indication to set a bias voltage supplied to the one or more LEDs to a test value, as depicted in block 610. The test value may be at least equal to a sum of a secondary drive voltage necessary to drive other components of the constant current LED pulsing drive circuit and the maximum forward voltage rating of each of the one or more LEDs. The method 600 may also include the step of receiving a voltage measurement taken at a node between the one or more LEDs and the other components of the constant current LED pulsing drive circuit, as depicted in block 612. The method 600 may also include the step of determining if the voltage measurement is greater than the secondary drive voltage, as depicted in block 614. Upon determining the voltage measurement is greater than the secondary drive voltage, the method 600 may also include sending a second indication to reduce the bias voltage supplied to the constant current LED pulsing drive circuit by the amount the voltage measurement exceeds the secondary drive voltage, as depicted in block 616.

From the foregoing, it will be seen that aspects described herein are well adapted to attain all the ends and objects hereinabove set forth together with other advantages which are obvious and which are inherent to the structure. Since many possible aspects described herein may be made without departing from the scope thereof, it is to be understood that all matter herein set forth or shown in the accompanying drawings is to be interpreted as illustrative and not in a limiting sense.

What is claimed is:

1. A method of operating a constant current light-emitting diode ("LED") pulsing drive circuit, the method comprising:

operating a constant current LED pulsing drive circuit for a first period of time;

subsequent to the first period of time, determining a minimum bias voltage required for the constant current LED pulsing drive circuit based on a forward voltage across a series of one or more LEDs;

adjusting an initial bias voltage applied to the series of one or more LEDs to the minimum bias voltage required for the constant current LED pulsing drive circuit; and subsequent to adjusting the initial bias voltage supplied, operating the constant current LED pulsing drive circuit for a second period of time.

2. The method of claim 1, wherein operating the constant current LED pulsing drive circuit comprises supplying pulsed currents to the constant current LED pulsing drive circuit, wherein each pulsed current has less than a 300 microsecond duration.

3. The method of claim 1, wherein the bias voltage includes a first voltage portion necessary for driving the series of one or more LEDs and a second voltage portion necessary for driving the other components of the constant current LED pulsing drive circuit.

4. The method of claim 3, wherein each of the one or more LEDs has an individual forward voltage, wherein the individual forward voltage of each of the one or more LEDs is within a range of forward voltages associated with a respective LED, wherein the range of forward voltages includes a maximum forward voltage.

5. The method of claim 4, wherein determining a minimum bias voltage required for the constant current LED pulsing drive circuit based on a forward voltage across a series of one or more LEDs comprises:

setting the initial bias voltage applied to the series of one or more LEDs to a test value, the test value being at least equal to a sum of the second voltage portion and the maximum forward voltage of each of the one or more LEDs;

measuring an actual forward voltage across the series of one or more LEDs;

determining an adjustment voltage based upon the measured actual forward voltage across the series of one or more LEDs; and subtracting the adjustment voltage from the test value to obtain the minimum bias voltage.

6. One or more computer-readable media having computer-executable instructions thereon that, when executed by one or more processors, cause the one or more processors to perform a method of periodically tuning a voltage supplied to a constant current LED pulsing drive circuit having one or more LEDs in series, wherein each of the one or more LEDs has a variable forward voltage that is less than a maximum forward voltage rating, and wherein each of the pulsed currents supplied to the constant current LED pulsing drive circuit lasts less than 300 microseconds, the method comprising:

sending a first indication to set a bias voltage applied to the one or more LEDs to a test value, the test value being at least equal to a sum of a secondary drive voltage necessary to drive other components of the constant current LED pulsing drive circuit and the maximum forward voltage rating of each of the one or more LEDs;

from a node positioned between the one or more LEDs and the other components, receiving a voltage measurement from the node to ground;

determining if the voltage measurement is greater than the secondary drive voltage; and upon determining that the voltage measurement is greater than the secondary drive voltage, sending a second indication to reduce the bias voltage supplied to the constant current LED pulsing drive circuit to reduce the voltage from the node to ground to the secondary drive voltage.

7. The one or more computer-readable media of claim 6, wherein the voltage measurement comprises a voltage received by an analog to digital converter that converts the voltage into a digital signal.

8. The one or more computer-readable media of claim 6, wherein the bias voltage applied to the one or more LEDs is adjustable by a direct current to direct current converter configured to increase and decrease the bias voltage applied in response to the first indication and the second indication, respectively.

9. The one or more computer-readable media of claim 8, wherein the second indication comprises a digital signal sent to a digital to analog converter configured to supply a feedback voltage to the direct current to direct current converter in response to the digital signal.

10. The one or more computer-readable media of claim 8, wherein the second indication comprises a digital signal sent to a pulse-width modulator configured to supply a feedback voltage to the direct current to direct current converter in response to the digital signal.

11. A constant current LED pulsing drive circuit comprising:

a voltage supply configured to supply a bias voltage;

one or more LEDs in series with the voltage supply, each of the one or more LEDs having a first drive voltage requirement necessary for lighting each of said one or more LEDs, the first drive voltage requirement being within a range of forward voltages between a minimum forward voltage and a maximum forward voltage;

one or more other components in series with the one or more LEDs, the one or more other components having a second drive voltage requirement;

a controller configured to control pulses of current passing through the one or more LEDs, wherein each of the pulses lasts less than 300 microseconds; and a sensor configured to determine an intermediate voltage of the constant current LED pulsing drive circuit at a node between the one or more LEDs and the one or more other components and, based upon the intermediate voltage, cause a signal to be sent to adjust the bias voltage.

12. The constant current LED pulsing drive circuit of claim 11, wherein the voltage supply comprises a direct current to direct current voltage converter having an input voltage lead configured to receive an input voltage, an output voltage lead configured to supply the bias voltage, and a feedback voltage lead configured to receive a feedback voltage for adjusting the bias voltage.

13. The constant current LED pulsing drive circuit of claim 12, wherein the sensor comprises:

an analog to digital converter having an intermediate voltage lead configured to receive the intermediate voltage and communicate a first digital signal corresponding to the intermediate voltage to a processor;

the processor configured to receive the first digital signal and determine if the intermediate voltage is higher than the second drive voltage requirement;

upon determining the intermediate voltage is higher than the second drive voltage requirement, the processor is configured to send a second digital signal to one of a digital to analog converter or a pulse-width modulator; and each of the digital to analog converter and the pulse-width modulator configured to receive the second digital signal and supply the feedback voltage to the direct current to direct current converter to reduce the bias voltage by an amount necessary to cause the intermediate voltage to equal the second drive voltage requirement.

14. The constant current LED pulsing drive circuit of claim 13, wherein the processor comprises one of a microprocessor unit and a microcontroller unit.

15. The constant current LED pulsing drive circuit of claim 12, wherein the one or more LEDs comprise a first series of one or more LEDs, the one or more other components in series with the one or more LEDs comprise a first array of one or more other components in series with the first series of one or more LEDs, the controller comprises a first controller, the node comprises a first node, and the intermediate voltage comprises a first intermediate voltage, the constant current LED pulsing drive circuit further comprising:

a second series of one or more LEDs in parallel with the first series of one or more LEDs and configured to receive the bias voltage supplied by the voltage supply, each LED of the second series of one or more LEDs having a third drive voltage requirement necessary for lighting said LED, the third voltage requirement being within a range of forward voltages between a minimum forward voltage and a maximum forward voltage;

a second array of one or more other components in series with the second series of one or more LEDs, the second array of one or more other components having a fourth drive voltage requirement;

a second controller configured to control pulses of current passing through the second series of one or more LEDs, wherein each of the pulses lasts less than 300 microseconds; and the sensor configured to detect a second intermediate voltage of the constant current LED pulsing drive circuit at a second node between the second series of one or more LEDs and the second array of one or more other components and, based in part upon the first intermediate voltage and in part upon the second intermediate voltage, send a signal to adjust the bias voltage.

16. The constant current LED pulsing drive circuit of claim 15, wherein the sensor comprises:

an analog to digital converter having a first intermediate voltage lead configured to receive the first intermediate voltage and a second intermediate voltage lead configured to receive the second intermediate voltage, the analog to digital converter configured to communicate a first digital signal corresponding to the first intermediate voltage and a second digital signal corresponding to the second intermediate voltage to a processor;

the processor configured to receive the first digital signal and the second digital signal and determine:

(A) a first voltage difference between the first intermediate voltage and the second drive voltage requirement, and (B) a second voltage difference between the second intermediate voltage and the fourth drive voltage requirement;

upon determining the first voltage difference and the second voltage difference, the processor configured to send a third digital signal corresponding to the lower of the first voltage difference and the second voltage difference to a digital to analog converter; and the digital to analog converter configured to receive the third digital signal and supply the feedback voltage to the direct current to direct current converter to reduce the bias voltage by an amount necessary to zero out the lower of the first voltage difference and the second voltage.

* * * * *